US009074430B2

(12) United States Patent
Levie et al.

(10) Patent No.: US 9,074,430 B2
(45) Date of Patent: Jul. 7, 2015

(54) COMPOSITE LIMIT COLLAR

(75) Inventors: William Iain Elder Levie, The Woodlands, TX (US); David Levie, Kastanienbaum (CH)

(73) Assignee: Halliburton Energy Services, Inc., Houston, TX (US)

( * ) Notice: Subject to any disclaimer, the term of this patent is extended or adjusted under 35 U.S.C. 154(b) by 796 days.

(21) Appl. No.: 13/236,987

(22) Filed: Sep. 20, 2011

(65) Prior Publication Data

US 2013/0068483 A1 Mar. 21, 2013

(51) Int. Cl.
*E21B 17/10* (2006.01)

(52) U.S. Cl.
CPC ..... *E21B 17/1028* (2013.01); *E21B 17/1042* (2013.01); *E21B 17/1078* (2013.01); *E21B 17/1085* (2013.01)

(58) Field of Classification Search
CPC ..... E21B 17/1042; E21B 17/1085; E21B 17/1078; E21B 17/10
USPC ..... 175/325.5; 166/241.6, 241.1
See application file for complete search history.

(56) References Cited

U.S. PATENT DOCUMENTS

| | | | | |
|---|---|---|---|---|
| 2,220,237 | A | 11/1940 | Hall | |
| 2,228,649 | A | 1/1941 | Welles | |
| 2,482,985 | A | 9/1949 | Lockwood | |
| 2,904,313 | A | 9/1959 | Wisenbaker | |
| 2,998,074 | A | 8/1961 | Casady et al. | |
| 3,063,760 | A * | 11/1962 | Gifford | 175/325.5 |
| 3,177,946 | A | 4/1965 | Hall, Sr. | |
| 3,209,836 | A | 10/1965 | Hall, Sr. | |
| 3,310,111 | A * | 3/1967 | Pavlich et al. | 166/295 |
| 3,343,608 | A | 9/1967 | Solum | |
| 3,410,613 | A * | 11/1968 | Kuus | 175/325.7 |
| 3,566,965 | A | 3/1971 | Solum | |
| 3,852,923 | A | 12/1974 | Hess | |
| 4,467,879 | A | 8/1984 | Burge | |
| 4,512,425 | A | 4/1985 | Brock | |
| 4,766,663 | A * | 8/1988 | Milam | 29/455.1 |
| 4,785,852 | A | 11/1988 | Okahashi et al. | |
| 4,794,986 | A | 1/1989 | Langer | |

(Continued)

FOREIGN PATENT DOCUMENTS

| | | | |
|---|---|---|---|
| CN | 1837572 | A | 9/2006 |
| CN | 100404784 | C | 7/2008 |

(Continued)

OTHER PUBLICATIONS

Office Action dated Apr. 26, 2013 (25 pages), U.S. Appl. No. 13/093,242, filed Apr. 25, 2011.

(Continued)

*Primary Examiner* — Giovanna C Wright
(74) *Attorney, Agent, or Firm* — John W. Wustenberg; Baker Botts L.L.P.

(57) ABSTRACT

A tubular component includes a limit collar disposed about the tubular component, and the limit collar comprises a body portion comprising a plurality of upsets disposed on an inner surface of the body portion, wherein the plurality of upsets define a first ring, a second ring, and at least one rib, at least one chamber formed between the inner surface of the body portion, an outer surface of the tubular component, and one or more surfaces of the first ring, the second ring, or the at least one rib, and a binder portion disposed in the at least one chamber.

21 Claims, 5 Drawing Sheets

(56) References Cited

U.S. PATENT DOCUMENTS

| | | | | |
|---|---|---|---|---|
| 5,027,914 | A | 7/1991 | Wilson | |
| 5,097,905 | A | 3/1992 | Goodwin | |
| 5,228,509 | A | 7/1993 | Ungemach et al. | |
| 5,358,039 | A | 10/1994 | Fordham | |
| 5,575,333 | A | 11/1996 | Lirette et al. | |
| 5,657,820 | A | 8/1997 | Bailey et al. | |
| 5,937,948 | A | 8/1999 | Robbins, III | |
| 5,988,276 | A | 11/1999 | Oneal | |
| 6,062,326 | A | 5/2000 | Strong et al. | |
| 6,065,537 | A | 5/2000 | Evans et al. | |
| 6,102,118 | A | 8/2000 | Moore | |
| 6,209,638 | B1 | 4/2001 | Mikolajczyk | |
| 6,285,014 | B1 | 9/2001 | Beck et al. | |
| 6,305,768 | B1 * | 10/2001 | Nishimoto | 312/406 |
| 6,371,203 | B2 | 4/2002 | Frank et al. | |
| 6,401,820 | B1 | 6/2002 | Kirk et al. | |
| 6,457,517 | B1 | 10/2002 | Goodson et al. | |
| 6,637,511 | B2 | 10/2003 | Linaker | |
| 6,659,173 | B2 | 12/2003 | Kirk et al. | |
| 6,679,325 | B2 | 1/2004 | Buytaert | |
| 6,830,102 | B2 | 12/2004 | Kirk et al. | |
| 6,997,254 | B2 | 2/2006 | Jenner | |
| 7,231,975 | B2 | 6/2007 | Lavaure et al. | |
| 7,412,761 | B2 | 8/2008 | Male et al. | |
| 7,516,782 | B2 | 4/2009 | Sheiretov et al. | |
| 7,748,476 | B2 | 7/2010 | Krueger | |
| 7,845,061 | B2 | 12/2010 | Buytaert et al. | |
| 7,861,744 | B2 | 1/2011 | Fly et al. | |
| 8,141,627 | B2 | 3/2012 | Krieg et al. | |
| 8,162,050 | B2 | 4/2012 | Roddy et al. | |
| 8,196,670 | B2 | 6/2012 | Jenner | |
| 8,220,563 | B2 | 7/2012 | Bangaru et al. | |
| 8,245,777 | B2 | 8/2012 | Garner | |
| 8,281,857 | B2 | 10/2012 | Willberg et al. | |
| 8,291,975 | B2 | 10/2012 | Roddy et al. | |
| 8,297,352 | B2 | 10/2012 | Roddy et al. | |
| 8,297,353 | B2 | 10/2012 | Roddy et al. | |
| 8,302,686 | B2 | 11/2012 | Roddy et al. | |
| 8,316,936 | B2 | 11/2012 | Roddy et al. | |
| 8,360,161 | B2 | 1/2013 | Buytaert et al. | |
| 2001/0037883 | A1 | 11/2001 | Veneruso et al. | |
| 2002/0139537 | A1 | 10/2002 | Young et al. | |
| 2002/0139538 | A1 | 10/2002 | Young et al. | |
| 2005/0224123 | A1 | 10/2005 | Baynham et al. | |
| 2007/0131414 | A1 | 6/2007 | Calderoni et al. | |
| 2007/0284037 | A1 * | 12/2007 | Buytaert | 156/294 |
| 2008/0035331 | A1 | 2/2008 | Buytaert | |
| 2008/0196900 | A1 | 8/2008 | Leibfried et al. | |
| 2008/0283236 | A1 | 11/2008 | Akers et al. | |
| 2009/0308615 | A1 | 12/2009 | Buytaert | |
| 2010/0218956 | A1 | 9/2010 | Buytaert et al. | |
| 2010/0252274 | A1 | 10/2010 | Buytaert et al. | |
| 2011/0042102 | A1 | 2/2011 | Buytaert | |
| 2011/0146971 | A1 | 6/2011 | Buytaert et al. | |
| 2011/0187556 | A1 | 8/2011 | Roddy et al. | |
| 2011/0199228 | A1 | 8/2011 | Roddy et al. | |
| 2012/0145410 | A1 | 6/2012 | Levie | |
| 2012/0145414 | A1 | 6/2012 | Nutley et al. | |
| 2012/0186808 | A1 | 7/2012 | Lively et al. | |
| 2012/0186828 | A1 | 7/2012 | Lively et al. | |
| 2012/0267121 | A1 | 10/2012 | Levie | |

FOREIGN PATENT DOCUMENTS

| | | | | |
|---|---|---|---|---|
| DE | 102005040482 | A1 | 3/2007 | |
| EP | 1235971 | B1 | 11/2005 | |
| GB | 2272925 | A | 6/1994 | |
| GB | 2304753 | A * | 3/1997 | E21B 17/10 |
| GB | 2431664 | A | 5/2007 | |
| JP | 60166516 | | 8/1985 | |
| WO | 0066874 | A1 | 11/2000 | |
| WO | 0146550 | A1 | 6/2001 | |
| WO | 0202904 | A1 | 1/2002 | |
| WO | 0248501 | A1 | 6/2002 | |
| WO | 2004015238 | A1 | 2/2004 | |
| WO | 2007143324 | A1 | 12/2007 | |
| WO | 2008015402 | A2 | 2/2008 | |
| WO | 2008144249 | A2 | 11/2008 | |
| WO | 2011025488 | A1 | 3/2011 | |
| WO | 2012076850 | A1 | 6/2012 | |
| WO | 2012076850 | A8 | 6/2012 | |
| WO | 2012101401 | A2 | 8/2012 | |
| WO | 2012101401 | A3 | 8/2012 | |
| WO | 2012101402 | A2 | 8/2012 | |
| WO | 2012101402 | A3 | 8/2012 | |
| WO | 2012146892 | A2 | 11/2012 | |
| WO | 2012146892 | A3 | 11/2012 | |
| WO | 2013043392 | A2 | 3/2013 | |

OTHER PUBLICATIONS

Foreign communication from a related counterpart application—International Search Report and Written Opinion, PCT/GB2012/000382, Aug. 9, 2013, 10 pages.

Notice of Allowance dated May 23, 2013 (15 pages), U.S. Appl. No. 12/964,605, filed Dec. 9, 2010.

Notice of Allowance dated Sep. 3, 2013 (14 pages), U.S. Appl. No. 13/093,242, filed Apr. 25, 2011.

Office Action (Final) dated Jul. 19, 2013 (19 pages), U.S. Appl. No. 13/013,266, filed Jan. 25, 2011.

Office Action (Final) dated Oct. 16, 2013 (19 pages), U.S. Appl. No. 13/013,259, filed Jan. 25, 2011.

Office Action dated Oct. 18, 2013 (13 pages), U.S. Appl. No. 13/013,266, filed Jan. 25, 2011.

Foreign communication from a related counterpart application—International Search Report and Written Opinion, PCT/US2009/055193, May 25, 2010, 10 pages.

Patent application entitled "Integral pull-through centralizer," by Iain Levie, filed Dec. 9, 2010 as U.S. Appl. No. 12/964,605.

Patent application entitled "Composite bow centralizer," by Glenn Lively, et al., filed Jan. 25, 2011 as U.S. Appl. No. 13/013,259.

Patent application entitled "Composite bow centralizer," by Glenn Lively, et al., filed Jan. 25, 2011 as U.S. Appl. No. 13/013,266.

Patent application entitled "Improved Limit Collar," by William Iain Elder Levie, filed Apr. 25, 2011 as U.S. Appl. No. 13/093,242.

"Specifications for bow-spring centralizers," API Specification 10D, Mar. 2002, 6th edition, 24 pages, American Petroleum Institute, Washington, D.C.

Office Action dated Mar. 27, 2013 (33 pages), U.S. Appl. No. 13/013,259, filed Jan. 25, 2011.

Office Action dated Apr. 1, 2013 (33 pages), U.S. Appl. No. 13/013,266, filed Jan. 25, 2011.

Foreign communication from a related counterpart application—International Preliminary Report on Patentability, PCT/US2009/055193, Feb. 28, 2012, 6 pages.

Foreign communication from a related counterpart application—International Preliminary Report on Patentability, PCT/GB2011/001704, Jun. 12, 2013, 9 pages.

Foreign communication from a related counterpart application—International Preliminary Report on Patentability, PCT/GB2012/000066, Jul. 30, 2013, 6 pages.

Foreign communication from a related counterpart application—International Preliminary Report on Patentability, PCT/GB2012/000067, Jul. 30, 2013, 6 pages.

Foreign communication from a related counterpart application—International Preliminary Report on Patentability, PCT/GB2012/000382, Oct. 29, 2013, 6 pages.

Foreign communication from a related counterpart application—International Search Report and Written Opinion, PCT/US2012/054153, Feb. 24, 2014, 10 pages.

Office Action dated Feb. 19, 2014 (13 pages), U.S. Appl. No. 13/013,259, filed Jan. 25, 2011.

Office Action dated Feb. 14, 2013 (31 pages), U.S. Appl. No. 12/964,605, filed Dec. 9, 2010.

Foreign communication from a related counterpart application—International Search Report, PCT/GB2011/001704, May 15, 2012, 5 pages.

(56) References Cited

OTHER PUBLICATIONS

Foreign communication from a related counterpart application—International Search Report and Written Opinion, PCT/GB2012/000066, Nov. 22, 2012, 10 pages.
Foreign communication from a related counterpart application—International Search Report and Written Opinion, PCT/GB2012/000067, Nov. 23, 2012, 11 pages.
Filing receipt and specification for patent application entitled "Composite Bow Centralizer," by Glenn Lively, et al., filed Aug. 5, 2014 as U.S. Appl. No. 14/452,271.
Filing receipt and specification for patent application entitled "Composite Bow Centralizer," by Glenn Lively, et al., filed Aug. 7, 2014 as U.S. Appl. No. 14/454,439.

* cited by examiner

COMPOSITE LIMIT COLLAR

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations that contain hydrocarbons to allow recovery of the hydrocarbons. Some wellbore servicing methods employ wellbore tubulars that are lowered into the wellbore for various purposes throughout the life of the wellbore. Various components can be disposed on the outer surface of a wellbore tubular to achieve a variety of effects during drilling, completion, and servicing operations. For example, centralizers can be used to maintain the wellbore tubulars aligned within the wellbore since wellbores are not generally perfectly vertical. Alignment may help prevent any friction between the wellbore tubular and the side of the wellbore wall or casing, potentially reducing any damage that may occur. Common components disposed about a wellbore tubular use limit collars, which are also referred to as stop collars or limit clamps, located at either end of the components to maintain the positioning of the component relative to the wellbore tubular as the tubular is conveyed into and out of the wellbore. The various components may be free to move within the limits of the limit collars. Traditional limit collars use one or more set screws passing through a metal stop collar and contacting the wellbore tubular to couple the stop collar to the tubular.

SUMMARY

In an embodiment, a tubular component includes a limit collar disposed about the tubular component, and the limit collar comprises a body portion comprising a plurality of upsets disposed on an inner surface of the body portion, wherein the plurality of upsets define a first ring, a second ring, and at least one rib, at least one chamber formed between the inner surface of the body portion, an outer surface of the tubular component, and one or more surfaces of the first ring, the second ring, or the at least one rib, and a binder portion disposed in the at least one chamber. The binder portion may engage the body portion and the tubular component. The body portion further may also include one or more holes, and a set screw that engages the tubular component may be disposed within one of the one or more holes. The rib may comprise one or more channels, and the plurality of upsets may further define a plurality of ribs. An edge adjacent an end of the body portion may be tapered.

In an embodiment, a method comprises providing a limit collar disposed on a wellbore tubular and a first component slidingly engaged on the wellbore tubular, wherein the limit collar comprises: a body portion comprising a plurality of recesses disposed on an inner surface of the body portion, wherein the plurality of recesses define a first ring, a second ring, and at least one rib; at least one chamber formed between a recess of the plurality of recesses, an outer surface of the wellbore tubular, and one or more surfaces of the first ring, the second ring, or the at least one rib; and a binder portion disposed in the at least one chamber; and conveying the wellbore tubular within a wellbore, wherein the first component is retained on the wellbore tubular due to the engagement of the first component with the limit collar. The limit collar may be comprised of non-metallic materials. The body portion or the binder portion may comprise a composite material, and the composite material comprises a matrix material. The matrix material may comprise a resin selected from the group consisting of: a thermosetting resin, a thermoplastic resin, an orthophthalic polyester, an isophthalic polyester, a phthalic/maelic type polyester, a vinyl ester, a thermosetting epoxy, a phenolic component, a cyanate component, a bismaleimide component, a nadic end-capped polyimide, a polysulfone, a polyamide, a polycarbonate, a polyphenylene oxide, a polysulfide, a polyether ether ketone, a polyether sulfone, a polyamide-imide, a polyetherimide, a polyimide, a polyacrylate, a liquid crystalline polyester, a polyurethane, a polyurea, and any combination thereof. The matrix material may comprise a two component resin comprising a hardenable resin selected from group consisting of: an organic resin, a bisphenol A diglycidyl ether resin, a butoxymethyl butyl glycidyl ether resin, a bisphenol A-epichlorohydrin resin, a bisphenol F resin, a polyepoxide resin, a novolak resin, a polyester resin, a phenol-aldehyde resin, a urea-aldehyde resin, a furan resin, a urethane resin, a glycidyl ether resin, an epoxide resin, and any combination thereof. The matrix material may comprise a two component resin comprising a hardening agent selected from group consisting of: a cyclo-aliphatic amine; an aromatic amine; an aliphatic amine; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; an indazole; an amine; a polyamine; an amide; a polyamide; 2-ethyl-4-methyl imidazole; and any combination thereof. The composite material may comprise a fiber selected from the group consisting of: a glass fiber, an e-glass fiber, an A-glass fiber, an E-CR-glass fiber, a C-glass fiber, a D-glass fiber, an R-glass fiber, an S-glass fiber, a cellulosic fiber, a carbon fiber, a graphite fiber, a ceramic fibers, an aramid fiber, and any combination thereof. The binder portion may comprise a curable resin and ceramic particulate filler material.

In an embodiment, a method comprises providing a wellbore tubular; providing a body portion comprising a plurality of upsets disposed on an inner surface of the body portion, wherein the plurality of upsets define a first ring, a second ring, and at least one rib; disposing the body portion about the wellbore tubular, wherein at least one chamber is formed between the inner surface of the body portion, an outer surface of the wellbore tubular, and one or more surfaces of the first ring, the second ring, or the at least one rib; and introducing a binder portion material into the at least one chamber. Disposing the body portion about the wellbore tubular may include disposing a set screw in a hole disposed in the body portion; and engaging the set screw with the wellbore tubular. The method may also include treating the outer surface of the wellbore tubular to provide a surface for bonding to the binder portion prior to disposing the body portion about the wellbore tubular. The binder portion material may be introduced into the at least one chamber through one or more holes disposed in the body portion. The method may also include disposing a set screw in a hole of the one or more holes into which the binder portion material is introduced after the binder portion has been introduced into the at least one chamber.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
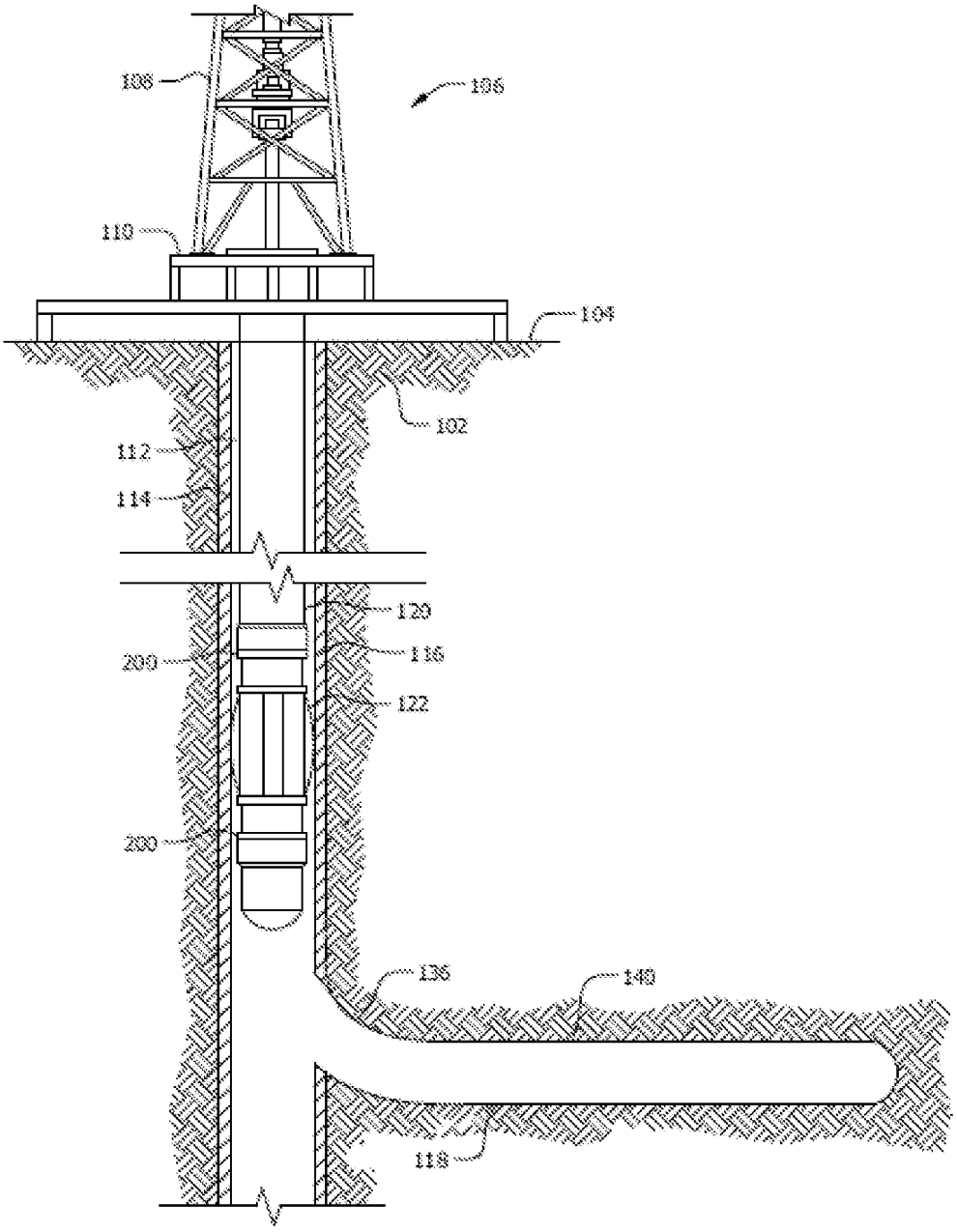
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward" meaning toward the surface of the wellbore and with "down," "lower," or "downward" meaning toward the terminal end of the well, regardless of the wellbore orientation. Reference to in or out will be made for purposes of description with "in," "inner," or "inward" meaning toward the center of the wellbore in a radial direction (i.e., towards the central axis of the wellbore and/or the limit collar) and with "out," "outer," or "outward" meaning towards the wall of the well in a radial direction, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

Referring to FIG. 1, an example of a wellbore operating environment is shown. As depicted, the operating environment comprises a drilling rig 106 that is positioned on the earth's surface 104 and extends over and around a wellbore 112 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells.

A wellbore tubular string 120 comprising a limit collar 200 may be lowered into the subterranean formation 102 for a variety of workover or treatment procedures throughout the life of the wellbore. The embodiment shown in FIG. 1 illustrates the wellbore tubular 120 in the form of a casing string being lowered into the subterranean formation with the limit collar retaining a centralizer 122. It should be understood that the wellbore tubular 120 comprising a limit collar 200 is equally applicable to any type of wellbore tubular being inserted into a wellbore, including as non-limiting examples drill pipe, production tubing, rod strings, and coiled tubing. The limit collar 200 may also be used to retain one or more components on various other tubular devices, cylindrical components, and/or downhole tools (e.g., various downhole subs and workover tools). In the embodiment shown in FIG. 1, the wellbore tubular 120 comprising the limit collar 200 is conveyed into the subterranean formation 102 in a conventional manner and may subsequently be secured within the wellbore 114 by filling an annulus 112 between the wellbore tubular 120 and the wellbore 114 with cement.

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the casing string 120 into the wellbore 114 to position the wellbore tubular 120 at a selected depth. While the operating environment depicted in FIG. 1 refers to a stationary drilling rig 106 for lowering and setting the wellbore tubular 120 comprising the limit collar 200 within a land-based wellbore 114, in alternative embodiments, mobile workover rigs, wellbore servicing units (such as coiled tubing units), and the like may be used to lower the wellbore tubular 120 comprising the limit collar 200 into a wellbore. It should be understood that a wellbore tubular 120 comprising the limit collar 200 may alternatively be used in other operational environments, such as within an offshore wellbore operational environment.

In alternative operating environments, a vertical, deviated, or horizontal wellbore portion may be cased and cemented and/or portions of the wellbore may be uncased. For example, uncased section 140 may comprise a section of the wellbore 114 ready for being cased with wellbore tubular 120. In an embodiment, a limit collar 200 may be used on production tubing in a cased or uncased wellbore. In an embodiment, a portion of the wellbore 114 may comprise an underreamed section. As used herein, underreaming refers to the enlargement of an existing wellbore below an existing section, which may be cased in some embodiments. An underreamed section may have a larger diameter than a section upward from the underreamed section. Thus, a wellbore tubular passing down through the wellbore may pass through a smaller diameter passage followed by a larger diameter passage.

Regardless of the type of operational environment in which the limit collar 200 is used, it will be appreciated that the limit collar 200 serves to limit the longitudinal movement and/or retain one or more components disposed about a wellbore tubular. In an embodiment, a plurality of limit collars 200 may be used to limit and/or retain one or more components about a wellbore tubular. As described in greater detail below with respect to FIG. 2A and FIG. 2B, the limit collar 200 comprises a body portion 202 and a binder portion 203 disposed between the body portion 202 and the wellbore tubular 220. In an embodiment, the limit collar 200 described herein may be used to retain one or more components 226 on the wellbore tubular 220. In an embodiment, the limit collar 200 may be formed from non-metallic and/or a composite materials and may be used to prevent corrosion on a metallic wellbore tubular.

Figure 2A:
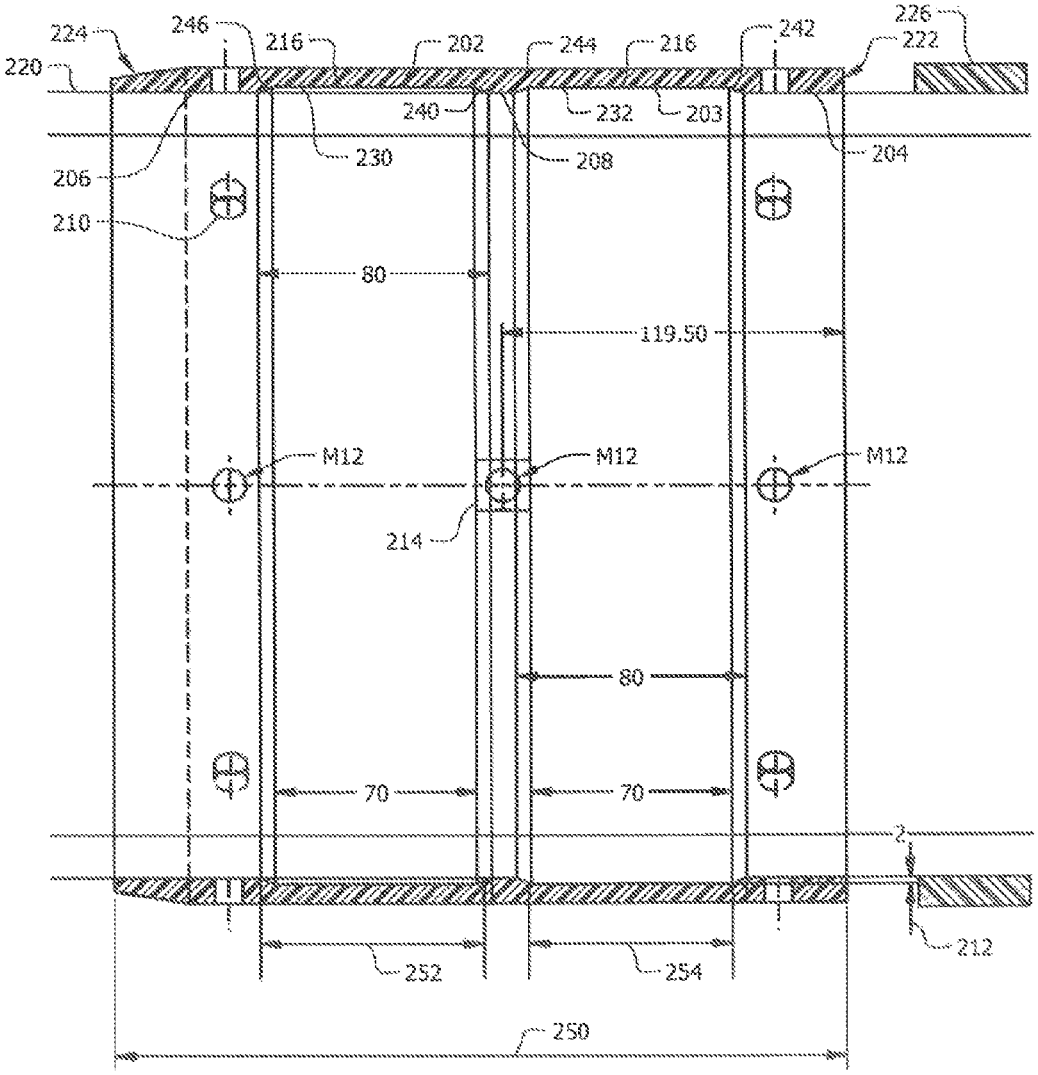
FIG. 2A is a cross-sectional view of a limit collar according to an embodiment.
Figure 2B:
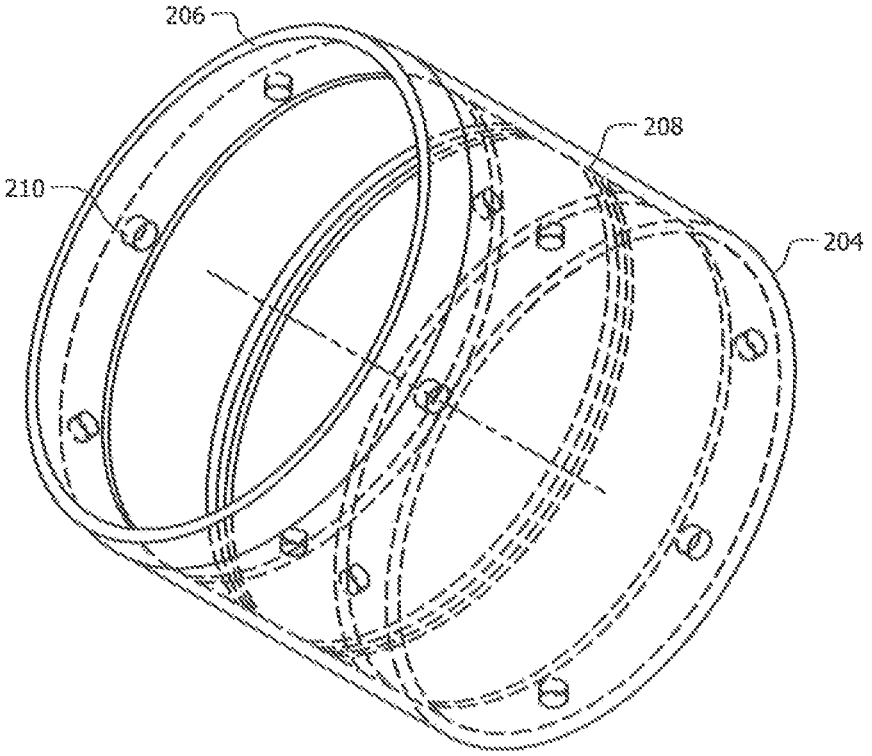
FIG. 2B is a isometric view of a limit collar according to an embodiment.

Referring now to FIG. 2A and FIG. 2B, an embodiment of the limit collar 200 disposed on a wellbore tubular 220 is shown in cross-section and as an isometric view, respectively. As described above, the limit collar 200 comprises a body portion 202 that comprises a plurality of rings 204, 206, one or more ribs 208, and one or more holes 210. In an embodiment, the body portion 202 comprises a first ring 204, a second ring 206, and a rib 208. The body portion 202 may comprise a generally cylindrical member having a flowbore disposed therethrough. The flowbore may be sized to be disposed about the outer diameter of a wellbore tubular 220. The outer diameter of the body portion 202 may be generally uniform along the outer surface of the body portion 202 in a longitudinal direction (i.e., a direction parallel to the central longitudinal axis of the limit collar 200 and wellbore tubular 220), though one or both ends may be tapered as described in more detail herein. One or more inner upsets (e.g., first ring 204, second ring 206, and/or rib 208) having an inner diameter less than the inner diameter of one or more recess portions 216 and having a radial height 212 may be disposed along the inner diameter of the body portion 202. A first ring 204 may be formed by one such inner upset disposed at a first end of the body portion 202. The first ring 204 may have an inner diameter chosen to allow the collar 200 to slidingly engage the wellbore tubular 220 while still maintaining contact with the outer surface of the wellbore tubular 220. In an embodiment, a small gap may exist between the inner diameter of the first ring 204 and the outer diameter of the wellbore tubular 220. In an embodiment, a layer of material may be disposed between the inner diameter of the first ring 204 and the outer diameter of the wellbore tubular 220 to substantially prevent fluid flow through the small gap. In an embodiment, the end 222 of the body portion 202 adjacent the first ring 204 may generally have a flat surface orientated normal to the outer surface of the wellbore tubular 220. This configuration may allow for uniform contact with the one or more components 226 retained on the wellbore tubular 220. In an embodiment, the end 222 may have a different configuration and/or orientation. The first ring 204 may be disposed about the interior surface of the body portion 202 to form a continuous ring around the entire inner surface of the body portion 202.

A second ring 206 may be formed by another such inner upset disposed at a second end of the body portion 202. The second ring 206 may have an inner diameter chosen to allow the collar 200 to slidingly engage the wellbore tubular 220 while still maintaining contact with the outer surface of the wellbore tubular 220. In an embodiment, a small gap may exist between the inner diameter of the second ring 206 and the outer diameter of the wellbore tubular 220. In an embodiment, a layer of material may be disposed between the inner diameter of the second ring 206 and the outer diameter of the wellbore tubular 220 to substantially prevent fluid flow through the small gap. In an embodiment, the edge 224 of the body portion 202 may be tapered or angled with respect to the surface of the wellbore tubular 220 to aid in movement of the limit collar 200 through the wellbore. In an embodiment, tapered or angled edge 224 is a leading edge in a direction of travel of the wellbore tubular 220 within the wellbore (e.g., a downhole leading edge as the wellbore tubular is being run into a wellbore). In an embodiment, tapered or angled edge 224 is the edge of the body portion 202 not in contact with the one or more components 226 retained on the wellbore tubular 220. The second ring 206 may be disposed about the interior surface of the body portion 202 to form a continuous ring around the entire inner surface of the body portion 202.

The body portion 202 may comprise one or more ribs 208 formed by one or more upsets disposed on the interior surface of the body portion 202. In an embodiment as shown in FIG. 2A and FIG. 2B, the body portion may comprise one rib 208. The rib 208 may have an inner diameter chosen to allow the collar 200 to slidingly engage the wellbore tubular 220 while still maintaining contact with the outer surface of the wellbore tubular 220. In an embodiment, a small gap may exist between the inner diameter of the rib 208 and the outer diameter of the wellbore tubular 220. In some embodiments, the rib 208 may have an inner diameter that does not engage the wellbore tubular 220, but rather leaves a gap between the interior surface of the rib 208 and the outer surface of the wellbore tubular 220. The rib 208 may be disposed about the interior surface of the body portion 202 to form a continuous ring around the entire inner surface of the body portion 202.

In an embodiment, the rib 208 may comprise one or more channels 214 disposed along the length of the rib 208. The channels 214 may comprise a recess disposed in the rib to provide a fluid communication pathway between the chambers 230, 232 formed by the one or more recesses 216, the outer surface of the wellbore tubular 220, and one or more edges of the corresponding inner upsets (e.g., first ring 204, second ring 206, and/or rib 208). The channel 214 may be formed along the inner surface of the body portion 202 through the rib 208 and may have a diameter generally equivalent to that of the recess 216. In an embodiment, the diameter of the channel 214 may be less than that of the recess 216 but greater than that of the rib 208. In an embodiment, the rib 208 may comprise 1 to about 20 channels, alternatively 2 to about 10 channels, or alternatively 2 to about 8 channels. When a plurality of channels 214 is present in a rib 208, the channels may be uniformly distributed along the circumference of the rib 208, or the channels may be non-uniformly distributed along the circumference of the rib 208.

The limit collar 200 may also have one or more holes 210 disposed through the body portion 202. The holes 210 may generally be cylindrical in shape and may pass through the first ring 204, the second ring 206, the rib 208, and/or the body portion adjacent the recesses 216. The holes 210 may be disposed in a generally radial direction to allow a set screw to engage the wellbore tubular 220 at an approximately normal angle. The interior surface of the holes 210 may be generally smooth, or in some embodiments, may be threaded to receive a set screw. In an embodiment, one or more holes 210 may be configured to receive a fluid connection for use in disposing the limit collar 200 on the wellbore tubular 220. When a hole 210 is disposed in a rib 208, the hole may be aligned with the channel 214 so that fluid communication is provided between the hole 210 and the channel 214. The set screws may be of any type known in the art. In an embodiment, the set screw is a non-metallic set screw, and the set screw may comprise a composite material of the same or similar type used to form the body portion 202, as described in more detail herein.

In an embodiment, the body portion 202 of the limit collar 200 may have a plurality of particulates disposed on the outer surface of the body portion 202. For example, the areas of the body portion 202 anticipated to contact a surface of a wellbore and/or tubular into which the wellbore tubular 220 comprising the limit collar 200 is placed may comprise one or more particulates to limit the effects of abrasion and/or erosion. The particulates may be disposed along the entire length of the outer surface of the limit collar 200 or only those portions anticipated to contact the wellbore wall during conveyance of the wellbore tubular 220 within the wellbore such as a tapered edge 224 of the end adjacent the second ring 206. As used herein, disposed on the outer surface generally refers to the particulates being located at the outer surface of the body portion 202 and may include the particulates being embedded in the outer surface, deposited in, on the outer surface, and/or coated on the outer surface. The particulates may generally be resistant to erosion and/or abrasion to prevent wear on the points of contact between the body portion 202 surfaces and the wellbore walls or inner surfaces of the wellbore. The shape, size, and composition of the particulates may be selected to affect the amount of friction between the limit collar 200 and the wellbore walls during conveyance of the wellbore tubular 220 comprising the limit collar 200 within the wellbore. In an embodiment, the particulates may comprise a low surface energy and or coefficient of friction, and/or may comprise substantially spherical particles. The particulates may have a distribution of sizes, or they may all be approximately the same size. In an embodiment, the particulates may be within a distribution of sizes ranging from about 0.001 inches to about 0.2 inches, 0.005 inches to about 0.1 inches, 0.01 inches to about 0.005 inches. In an embodiment, the particulates may be about 0.02 inches to about 0.004 inches. The particulates may comprise any material capable of resisting abrasion and erosion when disposed on a limit collar 200 and contacted with the wellbore wall. In an embodiment, the particulates may be formed from metal and/or ceramic. For example, the particulates may comprise zirconium oxide. In an embodiment, the particulates may be coated with any of the surface coating agents discussed below to aid in bonding between the particulates and one or more materials of construction of the limit collar 200 or any limit collar 200 components (e.g., the body portion 202 and/or the binder portion 203).

The body portion 202 and/or one or more set screws may be formed from one or more composite materials. A composite material comprises a heterogeneous combination of two or more components that differ in form or composition on a macroscopic scale. While the composite material may exhibit characteristics that neither component possesses alone, the components retain their unique physical and chemical identities within the composite. Composite materials may include a reinforcing agent and a matrix material. In a fiber-based composite, fibers may act as the reinforcing agent. The matrix material may act to keep the fibers in a desired location and orientation and also serve as a load-transfer medium between fibers within the composite.

The matrix material may comprise a resin component, which may be used to form a resin matrix. Suitable resin matrix materials that may be used in the composite materials described herein may include, but are not limited to, thermosetting resins including orthophthalic polyesters, isophthalic polyesters, phthalic/maelic type polyesters, vinyl esters, thermosetting epoxies, phenolics, cyanates, bismaleimides, nadic end-capped polyimides (e.g., PMR-15), and any combinations thereof. Additional resin matrix materials may include thermoplastic resins including polysulfones, polyamides, polycarbonates, polyphenylene oxides, polysulfides, polyether ether ketones, polyether sulfones, polyamide-imides, polyetherimides, polyimides, polyacrylates, liquid crystalline polyester, polyurethanes, polyureas, and any combinations thereof.

In an embodiment, the matrix material may comprise a two-component resin composition. Suitable two-component resin materials may include a hardenable resin and a hardening agent that, when combined, react to form a cured resin matrix material. Suitable hardenable resins that may be used include, but are not limited to, organic resins such as bisphenol A diglycidyl ether resins, butoxymethyl butyl glycidyl ether resins, bisphenol A-epichlorohydrin resins, bisphenol F resins, polyepoxide resins, novolak resins, polyester resins, phenol-aldehyde resins, urea-aldehyde resins, furan resins, urethane resins, glycidyl ether resins, other epoxide resins, and any combinations thereof. Suitable hardening agents that can be used include, but are not limited to, cyclo-aliphatic amines; aromatic amines; aliphatic amines; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; indazole; amines; polyamines; amides; polyamides; 2-ethyl-4-methyl imidazole; and any combinations thereof. In an embodiment, one or more additional components may be added the matrix material to affect the properties of the matrix material. For example, one or more elastomeric components (e.g., nitrile rubber) may be added to increase the flexibility of the resulting matrix material.

The fibers may lend their characteristic properties, including their strength-related properties, to the composite. Fibers useful in the composite materials used to form the body portion 202 may include, but are not limited to, glass fibers (e.g., e-glass, A-glass, E-CR-glass, C-glass, D-glass, R-glass, and/or S-glass), cellulosic fibers (e.g., viscose rayon, cotton, etc.), carbon fibers, graphite fibers, metal fibers (e.g., steel, aluminum, etc.), ceramic fibers, metallic-ceramic fibers, aramid fibers, and any combinations thereof. In an embodiment, only non-metallic fibers may be used. Additional components that may be used with the fibers or in place of the fibers may include particulates and/or chopped fibers comprising ceramic, polymer, metals, oxides, or other suitable composite materials including any of the materials described with respect to the fibers but in particulate and/or chopped fiber form.

The strength of the interface between the fibers and the matrix material may be modified or enhanced through the use of a surface coating agent. The surface coating agent may provide a physico-chemical link between the fiber and the resin matrix material, and thus may have an impact on the mechanical and chemical properties of the final composite. The surface coating agent may be applied to fibers during their manufacture or any other time prior to the formation of the composite material. Suitable surface coating agents may include, but are not limited to, surfactants, anti-static agents, lubricants, silazane, siloxanes, alkoxysilanes, aminosilanes, silanes, silanols, polyvinyl alcohol, and any combinations thereof.

The body portion 202 comprising a composite material may be formed using any techniques known for forming a composite material into a desired shape. The fibers used in the process may be supplied in any of a number of available forms. For example, the fibers may be supplied as individual filaments wound on bobbins, yarns comprising a plurality of fibers wound together, tows, rovings, tapes, fabrics, other fiber broadgoods, or any combinations thereof. The fiber may pass through any number rollers, tensioners, or other standard elements to aid in guiding the fiber through the process to a resin bath.

In an embodiment, a fiber may first be delivered to a resin bath. The resin may comprise any of those resins or combination of resins known in the art, including those listed herein. The resin bath can be implemented in a variety of ways. For example, the resin bath may comprise a doctor blade roller bath wherein a polished rotating cylinder that is disposed in the bath picks up resin as it turns. The doctor bar presses against the cylinder to obtain a precise resin film thickness on cylinder and pushes excess resin back into the bath. As the fiber passes over the top of the cylinder and is in contact with the cylinder, the fiber may contact the resin film and wet out. In another embodiment, resin bath may comprise an immersion bath where the fiber is partially or wholly submerged into the resin and then pulled through a set of wipers or roller that remove excess resin.

After leaving the resin bath, the resin-wetted fiber may pass through various rings, eyelets, and/or combs to direct the resin-wetted fiber to a mold to form the body portion 202. In an embodiment, the mold may comprise a generally cylindrical mandrel having one or more features to cause the formation of the recesses 216. In another embodiment, the mold may comprise a cylindrical mandrel with a generally smooth surface and the recesses 216 may be formed after the body portion has been allowed to harden and/or set. The mold upon which the resin-wetted fibers are wound may have a diameter approximately the same as the diameter of a wellbore tubular upon which the final limit collar 200 is to be disposed. The fibers may be wound onto the mold to form the body portion 202 using an automated process that may allow for control of the direction of the winding and the winding pattern. The winding process may determine the thickness profile of the body portion 202 in the formation process. In an embodiment, particulates, which may comprise a surface coating agent, may be disposed on the outer surface of the body portion after the fibers leave the resin bath and/or when disposed on the mold.

The wound fibers may be allowed to harden, cure, and/or set to a desired degree on the mold. In an embodiment, the particulates, which may comprise a surface coating agent, may be disposed on the outer surface of the body portion. The mold may then be heated to heat cure the resin to a final, cured state. In another embodiment, other curing techniques may be used to cause the body portion to harden to a final, cured state. After completing the curing process, the mold may be disassembled and the body portion removed. In an embodiment, the body portion may be removed from the mold by pressing the cylindrical mandrel out of the body portion. In an embodiment in which the cylindrical mandrel has a generally smooth surface, the recesses may be milled, cut, or otherwise formed on the inner surface of the body portion after the body portion is removed from the cylindrical mandrel. The limit collar may then be formed by disposing the body portion on the wellbore tubular and introducing the binder portion 203 as described in more detail herein.

The winding process used to form the body portion 202 may determine the direction of the fibers and the thickness of the rings 204, 206, the recess portions 216, and/or the one or more ribs 208. The ability to control the direction and pattern of winding may allow for the properties of the completed limit collar 200 to possess direction properties. In an embodiment, the fibers in the body portion 202 may generally be aligned in a circumferential direction, though various cross winding patterns may also be useful.

In an embodiment, the body portion 202 formation process may be designed by and/or controlled by an automated process, which may be implemented as software operating on a processor as part of a computer system. The automated process may consider various desired properties of the limit collar as inputs and calculate a design of the limit collar based on the properties of the available materials and the available manufacturing processes. In an embodiment, the automated process may consider various properties of the materials available for use in the construction of the limit collar including, but not limited to, the diameter, stiffness, moduli, and cost of the fibers. The use of the automated process may allow for limit collars to be designed for specific uses and allow the most cost effective design to be chosen at the time of manufacture. Thus, the ability to tailor the design of the limit collar to provide a desired set of properties may offer an advantage of the limit collar and methods disclosed herein. In an embodiment, the body portion 202 may be manufactured at a location separated from the wellbore tubular and/or the wellbore, and installed at the wellbore through the introduction of the binder portion into the body portion.

In an embodiment, one or more set screws may be prepared using a similar process to that used to form the body portion. For example, a sheet of composite material may be formed, and one or more set screws may be cut, milled, or otherwise shaped from the material. Alternatively, the set screws may be individually formed from a non-metallic material, resin, and/or a composite material. One or more threads may be machined into and/or integrally formed (e.g., through the use of a mold comprising the corresponding thread pattern) with the set screw.

The binder portion 203 can comprise any material that engages, couples, and/or bonds to the wellbore tubular 2220 and/or the body portion 202 via the formation of a chemical and/or mechanical bond to retain the body portion 202 in position relative to the wellbore tubular 220. The binder portion 203 may be disposed within the chambers 230, 232 formed by the one or more recesses 216, the outer surface of the wellbore tubular 220, and one or more edges of the corresponding inner upsets (e.g., first ring 204, second ring 206, and/or rib 208). The binder portion 203 may be disposed between the first ring 204 and the wellbore tubular 220 in a small gap therebetween. Similarly, the binder portion 203 may also be disposed between the second ring 206 and/or the rib 208 and the wellbore tubular 220 in a small gap therebetween. In an embodiment, the binder portion 203 may bond to the wellbore tubular 220 over the contact area between the binder portion 203 and the wellbore tubular 220, and the binder portion 203 may bond to the body portion 202 over the contact area between the binder portion 203 and the body portion 202. Once formed, the binder portion 220 may also retain the body portion 202 on the wellbore tubular 220 through the formation of a physical retaining structure disposed within the body portion 202 in chambers 230, 232. For example, the binder portion 203 may provide a physical retaining force through the interaction of the outer edge of the binder portion 203 with the inner edge of the body portion 202 at the interfaces 240, 242 when the body portion experiences a longitudinal force directed from the end 222 to the end 224. Similarly, the binder portion 203 may provide a physical retaining force through the interaction of the outer edge of the binder portion 203 with the inner edge of the body portion 202 at the interfaces 244, 246 when the body portion experiences a longitudinal force directed from the end 224 to the end 222.

The binder portion 203 may comprise any material capable of being disposed within the chambers 230, 232 and forming the chemical and/or mechanical bond to retain the body portion 202 in position relative to the wellbore tubular 220. In an embodiment, the binder portion 203 may include, but is not limited to, a composite, a resin, an epoxy, or any combination thereof. The binder portion 203 may be disposed and/or bonded to the wellbore tubular 220 and/or body portion 202 using any known techniques for applying the desired material. For example, an injection method, molding, curing, or any combination thereof may be used to apply the binder portion 203 within the chambers 230, 232, as discussed in more detail herein. The binder portion 203 may generally be disposed within the chambers 230, 232 so as to substantially fill the chambers 230, 232.

The binder portion 203 of the limit collar 200 may comprise one or more composite materials. The matrix material of the binder portion 203 may comprise a resin component, which may be used to form a resin matrix. Suitable resin matrix materials that may be used in the composite materials described herein may include, but are not limited to, any of the resin materials, two-component resin compositions, and/or combinations thereof described herein for use with the body portion 202. The matrix material of the binder portion 203 may or may not comprise any fibers or particulates such as those described with respect to the body portion above, which may include particulates and/or chopped fibers. The strength of the interface between the fibers, chopped fibers, and/or particulates and the matrix material may be modified or enhanced through the use of a surface coating agent including any of those described herein. In an embodiment, a matrix material or any components thereof in the body portion may be the same or different as the matrix material or any components thereof in the binder portion 203.

In an embodiment, the binder portion 203 may comprise a ceramic based resin including, but not limited to, the types disclosed in U.S. Patent Application Publication Nos. US 2005/0224123 A1, entitled "Integral Centraliser" and published on Oct. 13, 2005, and US 2007/0131414 A1, entitled "Method for Making Centralizers for Centralising a Tight Fitting Casing in a Borehole" and published on Jun. 14, 2007, both of which are incorporated herein by reference in their entirety. For example, in some embodiments, the resin material may include bonding agents such as an adhesive or other curable components. In some embodiments, components to be mixed with the resin material may include a hardener, an accelerator, or a curing initiator. Further, in some embodiments, a ceramic based resin composite material may comprise a catalyst to initiate curing of the ceramic based resin composite material. The catalyst may be thermally activated. Alternatively, the mixed materials of the composite material may be chemically activated by a curing initiator. More specifically, in some embodiments, the composite material of the binder portion 203 may comprise a curable resin and ceramic particulate filler materials.

The length 250 of the limit collar 200 and/or the length 252, 254 of one or more of the binder portions 203 may be chosen to provide a sufficient retaining force for the limit collar 200. When the binder portion 203 is disposed and/or bonded to the wellbore tubular 220, a mechanical and/or chemical bond may be formed over the contact surface. Accordingly, the length 250, length 252, and/or length 254 may be chosen to provide a surface area over which the mechanical and/or chemical bond can act to provide a total retaining force at or above a desired level. In an embodiment, the total retaining force may meet or exceed a load rating or specification for the limit collar 200. The surface area over which the mechanical and/or chemical bond can act may be determined at least in part based on the length 250, length 252, and/or length 254 and the diameter of the wellbore tubular 220 at the contact surface. Any surface treatments of the wellbore tubular 220 and/or the inner surface of the body portion 202 in contact with the binder portion 203 may be considered when determining the length 250, length 252, and/or length 254.

Figure 3:
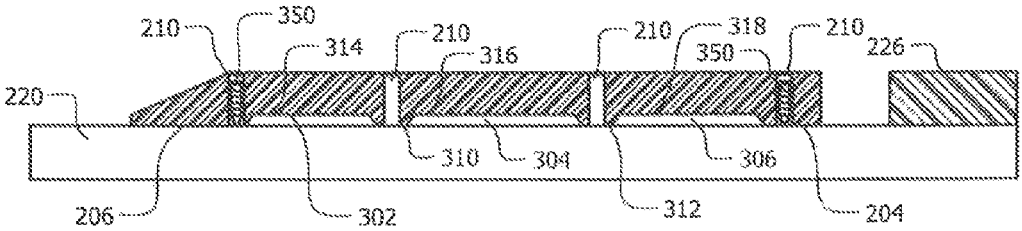
FIG. 3 is another cross-sectional view of a limit collar according to an embodiment.

In an embodiment, three or more chambers may be provided in which the binder portion may be disposed to provide a desired retaining force for the limit collar 200 on the wellbore tubular 220. As shown in FIG. 3, a plurality of ribs 310, 312 may be provided along with the first ring 204 and the second ring 206 to provide for a plurality of chambers 302, 304, 306. As described above, the chambers 302, 304, 306 may be formed by the one or more recesses 314, 316, 318, the outer surface of the wellbore tubular 220, and the corresponding inner upsets (e.g., first ring 204, second ring 206, rib 310, and/or rib 312). For example, chamber 302 may be formed by the inner surface of the body portion 202 within the recess 314, the outer surface of the wellbore tubular 220, and the corresponding inner edges of the second ring 206 and the rib 310. Chamber 304 may be formed by the inner surface of the body portion 202 within the recess 316, the outer surface of the wellbore tubular 220, and the corresponding inner edges of the rib 310 and the rib 312. Similarly, chamber 306 may be formed by the inner surface of the body portion 202 within the recess 318, the outer surface of the wellbore tubular 220, and the corresponding inner edges of the rib 312 and the first ring 204. One or more holes 210 may be disposed in one or more of the first ring 204, second ring 206, rib 310, and/or rib 312. One or more screws 350 may be disposed within one of the one or more holes and may engage the wellbore tubular 220. One or more channels as described above may be provided in one or more of the ribs when a plurality of ribs is present. While not shown in FIG. 3, one or more holes may be disposed in the body portion adjacent to the chambers 302, 304, 306 to provide fluid communication between two or more of the chambers 302, 304, 306.

While FIG. 3 illustrates two ribs 310, 312 and three corresponding chambers 302, 304, 306, any number of ribs and chambers may be provided. In an embodiment, the body portion may comprise one rib, two ribs, three ribs, four ribs, five ribs, six ribs, seven ribs, eight ribs, nine ribs, or alternatively ten ribs. In an embodiment, the limit collar 200 may comprise two chambers, three chambers, 4 chambers, five chambers, six chambers, seven chambers, eight chambers, nine chambers, ten chambers, or alternatively ten chambers. When the limit collar 200 comprises a plurality of ribs, the ribs may be evenly spaced along the longitudinal length of the limit collar between the first ring 204 and the second ring 206, or the ribs may be unevenly spaced along the longitudinal length of the limit collar between the first ring 204 and the second ring 206. Further, the longitudinal length of each rib may vary, the number and configuration of any channels may vary, and the number and configuration of the holes 210 may vary from rib to rib.

With reference to FIG. 2A and FIG. 2B, the limit collar 200 may be disposed on the wellbore tubular 220 using a variety of methods. In an embodiment, the method used to dispose the limit collar 200 on the wellbore tubular 220 may depend, at least in part, on the material or materials used to form the body portion 202 and the binder portion 203. The body portion 202 may be formed as described herein and then be disposed on or about the wellbore tubular 220. In an embodiment, the body portion may be passed over an end of the wellbore tubular 220, for example before the wellbore tubular 220 is configured into a wellbore tubular string. One or more set screws may be disposed within one or more holes 210. The set screws may engage the wellbore tubular 220 surface to retain the body portion 202 in position on the wellbore tubular 220. One or more of the holes 210 may be left open without a set screw for applying the binder portion 203 to the body portion 202.

In an embodiment, the wellbore tubular may first be treated to prepare the surface for receiving the body portion 202. In this process, the outer surface of the wellbore tubular 220 may be optionally prepared using any known technique to clean and/or provide a suitable surface for bonding the binder portion 203 material to the wellbore tubular 220. In an embodiment, the surface of the wellbore tubular 220 may be metallic. The attachment surface may be prepared by sanding, sand blasting, bead blasting, chemically treating the surface, heat treating the surface, or any other treatment process to produce a clean surface for applying the binder portion to the wellbore tubular 220. In an embodiment, the preparation process may result in the formation of one or more surface features such as corrugation, stippling, or otherwise roughening of the surface, on a microscopic or macroscopic scale, to provide an increased surface area and suitable surface features to improve bonding between the surface and the binder portion 203 material or materials.

The binder portion 203 may then be applied to the body portion 202 to form the limit collar 200. The binder portion 203 may be applied using a variety of methods to allow the binder portion 203 to engage, couple, and/or bond to the wellbore tubular 220 and/or the body portion 202. When the binder portion 203 comprises a composite, a ceramic, a resin, and/or an epoxy, the material or materials forming the binder portion 203 may be fluids that may be provided prior to an application process such as injection and/or molding. In an embodiment, the binder portion 203 material or materials may be provided as separate two-part raw material components for admixing during injection and/or molding and whereby the whole can be reacted. The reaction may be catalytically controlled such that the various components in the separated two parts of the composite material do not react until they are brought together under suitable injection and/or molding conditions. Thus, one part of the two-part raw material may include an activator, initiator, and/or catalytic component required to promote, initiate, and/or facilitate the reaction of the whole mixed composition. In some embodiments, the appropriate balance of components may be achieved by the use of pre-calibrated mixing and dosing equipment.

In an embodiment, the binder portion 203 may be applied to the body portion 202 through one or more of the holes 210. The body portion 202 may be retained in position over the optionally prepared wellbore tubular 220 surface through the use of the set screws. A connection mechanism may be used to provide the binder portion 203 material or materials to one or more of the holes 210 in the body portion 202. The binder portion 203 material or materials described herein may then be introduced into the one or more holes 210. The binder portion 203 material or materials may flow through the one or more holes 210 into the chambers 230, 232 and harden and/or set to form the binder portion 203. The binder portion 203 material or materials may be introduced into one chamber and allowed to flow through one or more of the channels 214 into one or more additional chambers. In an embodiment, the hole or holes 210 into which the binder portion 203 material or materials are introduced may correspond to a rib and/or a channel 214. For example, one or more of the holes 210 into which the binder portion 203 material or materials are introduced may correspond to the hole 210 in communication with the channel 214 to allow the binder portion 203 material or materials to flow into chambers 230, 232. The binder portion 203 material or materials may flow from the hole into the space between the inner surface of the rib 208 and the outer surface of the wellbore tubular 220 into one or more chambers. In an embodiment, the binder portion 203 material or materials may be introduced into a plurality of holes 210 simultaneously or sequentially to introduce the binder portion material or materials into the chambers. In an embodiment, multiple portions of a multi-part resin may be introduced into separate holes and allowed to mix within one or more of the chambers. In an embodiment, different binder portion materials may be introduced into different chambers to produce a limit collar 200 with different binder portion 203 material profiles.

While the first ring 204, the second ring 206, and/or one or more ribs may be configured to contact or nearly contact the surface of the wellbore tubular 220, a small gap may be present between the first ring 204, the second ring 206, and/or one or more ribs and the outer surface of the wellbore tubular 220. As the binder portion 203 is introduced into the body portion 202, the binder portion 203 may be introduced to substantially file the chambers, and in an embodiment, the binder portion may be introduced until the binder portion 203 material or materials flow out through the small gaps from the first ring 204 and/or the second ring 206. In an embodiment, an adhesive layer such as a layer of adhesive tape or double sided adhesive tape may be applied between the first ring 204 and/or the second ring 206 to substantially prevent any fluid communication between the chambers 230, 232 and the exterior of the limit collar 200. In this way, the binder portion 203 may extend between the inner surface of the first ring 204, second ring 206, and/or one or more ribs and the outer surface of the wellbore tubular 220.

Once introduced into one or more of the chambers, the limit component 202 material or materials may be allowed to harden and/or set. In an embodiment, the one or more holes into which the binder portion 203 material or materials are introduced may receive a set screw to seal the one or more holes 210 as the binder portion hardens and/or sets. In an embodiment, heat may be applied to thermally activate a thermally setting resin, or a sufficient amount of time may be provided for the curing of the binder portion 203 material or materials. In an embodiment, a plurality of binder portion 203 materials may be used with multiple injection periods and/or multiple holes 210 to produce a desired limit collar 200 structure and/or composition.

Figure 4:
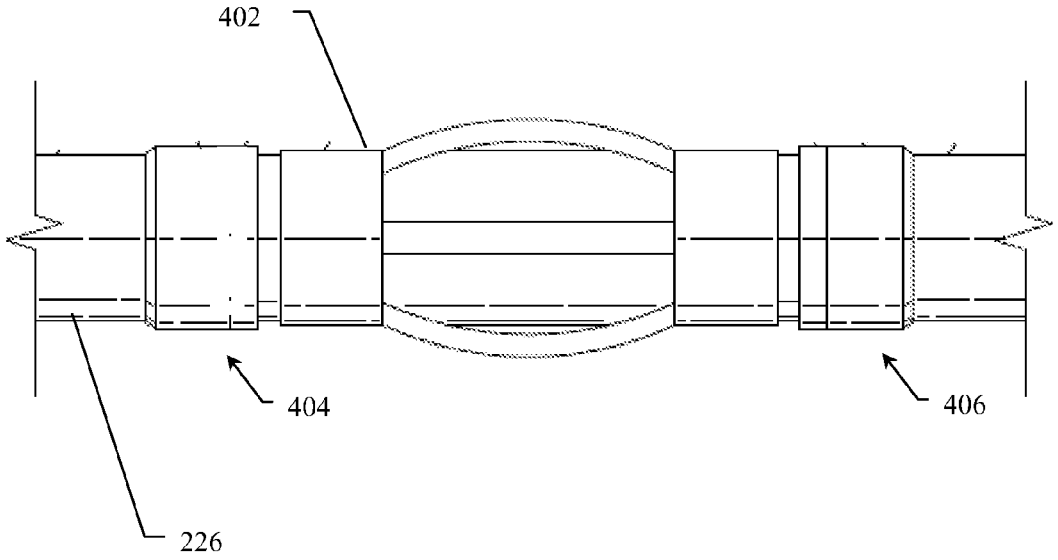
FIG. 4 is still another cross-sectional view of a limit collar according to an embodiment.

As shown in FIG. 4, a wellbore tubular 220 comprising a limit collar 404, 406 retaining a component 402 may be provided using one or more of the limit collars described herein. In an embodiment, the component 402 retained on the wellbore tubular 220 may comprise any number of components including, but not limited to, a centralizer, a packer, a cement basket, various cement assurance tools, testing tools, and the like. In an embodiment, the component 402 may comprise a centralizer of the type disclosed in U.S. patent application Ser. No. 13/013,259, entitled "Composite Bow Centralizer" by Lively et al. and filed on Jan. 25, 2011, which is incorporated herein by reference in its entirety. The component 402 may be slidingly engaged with the wellbore tubular 220 to allow for movement relative to the wellbore tubular 220. The component 402 may be retained on the wellbore tubular 220 by forming a limit collar 404 using any of the methods described herein, followed by disposing one or more components 402 about the wellbore tubular 220. The component 402 may be configured to move relative to the wellbore tubular 220 while being retained when the component 402 engages the limit collar 404. One or more additional limit collars 406 may be formed using any of the methods described herein, thereby retaining the component 402 on the wellbore tubular 220 between the two limit collars 404, 406. Once formed, the wellbore tubular 220 comprising at least one limit collar 404 and the component 402 to be retained on the wellbore tubular 220 may be placed within a wellbore.

The wellbore tubular 220 ma then be conveyed within the wellbore, and the first component may be retained on the wellbore tubular due to the engagement of the first component with the limit collar.

In an embodiment, a plurality of components retained by a plurality of limit collars according to the present disclosure may be used with one or more wellbore tubular sections. A wellbore tubular string refers to a plurality of wellbore tubular sections connected together for conveyance within the wellbore. For example, the wellbore tubular string may comprise a casing string conveyed within the wellbore for cementing. The wellbore casing string may pass through the wellbore prior to the first casing string being cemented, or the casing string may pass through one or more casing strings that have been cemented in place within the wellbore. As another example, the wellbore tubular string may comprise a production string conveyed within the wellbore to produce one or more hydrocarbons from the wellbore and/or inject one or more injection fluids into the wellbore. In an embodiment, the wellbore tubular string may comprise premium connections, flush connections, and/or nearly flush connections. A plurality of limit collars as described herein may be used on the wellbore tubular string to maintain one or more components (e.g., a centralizer or a plurality of centralizers) on the wellbore tubular string as it is conveyed within the wellbore. The number of limit collars and their respective spacing along a wellbore tubular string may be determined based on a number of considerations including the properties of each component being retained on the wellbore tubular, the properties of the wellbore tubular (e.g., the sizing, the weight, etc.), and the properties of the wellbore through which the wellbore tubular is passing (e.g., the annular diameter, the tortuosity, the orientation of the wellbore, etc.). In an embodiment, a wellbore design program may be used to determine the number and type of the limit collars and components retained on the wellbore tubular string based on the various inputs as described herein. The number and spacing of the limit collars and components retained by the limit collars along the wellbore tubular may vary along the length of the wellbore tubular based on the expected conditions within the wellbore.

As described herein, the limit collar may be used with a wellbore tubular disposed within a wellbore in a subterranean formation. The limit collar described herein may be formed from non-metallic components to help prevent corrosion of the wellbore tubular. When metallic limit collar components of different compositions are provided within the wellbore and in contact with the wellbore tubular, a galvanic cell may be established in the presence of an electrolytic solution, resulting in corrosion of the limit collar and/or the wellbore tubular. As the metallic components corrode and/or degrade, unwanted metallic components may be deposited within the wellbore. By providing a non-metallic limit collar, the corrosion of the wellbore tubular may be prevented. Further, the use of the body portion may provide the desired strength of the limit collar through the use of a composite material while the use of the binder portion may provide the desired retaining force of the limit collar on the wellbore tubular. The limit collar described herein may also be quickly and easily installed at the well site without the need for metal working equipment.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A tubular component comprising:

a limit collar disposed about the tubular component, wherein the limit collar comprises:

a body portion comprising a plurality of upsets disposed on an inner surface of the body portion, wherein the plurality of upsets define a first ring, a second ring, and at least one rib, wherein the at least one rib comprises one or more channels extending through the at least one rib;

a plurality of chambers formed between the inner surface of the body portion, an outer surface of the tubular component, and one or more surfaces of the first ring, the second ring, or the at least one rib, wherein the one or more channels provide fluid communication between at least two chambers of the plurality of chambers that are adjacent to the at least one rib;

one or more holes disposed through at least one of the first ring, the second ring, and the at least one rib, wherein the one or more holes are in fluid communication with at least one of the plurality of chambers; and a binder portion disposed in the at least one chamber of the plurality of chambers.

2. The tubular component of claim 1, wherein the binder portion engages the body portion and the tubular component.

3. The tubular component of claim 1, wherein the body portion further comprises a set screw that engages the tubular component disposed within one of the one or more holes.

4. The tubular component of claim 1, wherein the plurality of upsets further define a plurality of ribs.

5. The tubular component of claim 1, wherein an edge adjacent an end of the body portion is tapered.

6. A method comprising:

providing a limit collar disposed on a wellbore tubular and a first component slidingly engaged on the wellbore tubular, wherein the limit collar comprises:

a body portion comprising a plurality of recesses disposed on an inner surface of the body portion, wherein the plurality of recesses define a first ring, a second ring, and at least one rib, wherein the rib comprises one or more channels extending through the at least one rib;

a plurality of chambers formed between the plurality of recesses, an outer surface of the wellbore tubular, and one or more surfaces of the first ring, the second ring, or the at least one rib, wherein the one or more channels provide fluid communication between at least two chambers of the plurality of chambers that are adjacent to the at least one rib, wherein one or more holes are disposed through at least one of the first ring, the second ring, and the at least one rib, wherein the one or more holes are in fluid communication with at least one of the plurality of chambers; and a binder portion disposed in the at least one chamber; and conveying the wellbore tubular within a wellbore, wherein the first component is retained on the wellbore tubular due to the engagement of the first component with the limit collar.

7. The method of claim 6, wherein the limit collar is comprised of non-metallic materials.

8. The method of claim 6, wherein the body portion or the binder portion comprise a composite material.

9. The method of claim 8, wherein the composite material comprises a matrix material.

10. The method of claim 9, wherein the matrix material comprises a resin selected from the group consisting of: a thermosetting resin, a thermoplastic resin, an orthophthalic polyester, an isophthalic polyester, a phthalic/maelic type polyester, a vinyl ester, a thermosetting epoxy, a phenolic component, a cyanate component, a bismaleimide component, a nadic end-capped polyimide, a polysulfone, a polyamide, a polycarbonate, a polyphenylene oxide, a polysulfide, a polyether ether ketone, a polyether sulfone, a polyamide-imide, a polyetherimide, a polyimide, a polyacrylate, a liquid crystalline polyester, a polyurethane, a polyurea, and any combination thereof.

11. The method of claim 9, wherein the matrix material comprises a two component resin comprising a hardenable resin selected from group consisting of: an organic resin, a bisphenol A diglycidyl ether resin, a butoxymethyl butyl glycidyl ether resin, a bisphenol A-epichlorohydrin resin, a bisphenol F resin, a polyepoxide resin, a novolak resin, a polyester resin, a phenol-aldehyde resin, a urea-aldehyde resin, a furan resin, a urethane resin, a glycidyl ether resin, an epoxide resin, and any combination thereof.

12. The method of claim 9, wherein the matrix material comprises a two component resin comprising a hardening agent selected from group consisting of: a cyclo-aliphatic amine; an aromatic amine; an aliphatic amine; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; an indazole; an amine; a polyamine; an amide; a polyamide; 2-ethyl-4-methyl imidazole; and any combination thereof.

13. The method of claim 8, wherein the composite material comprises a fiber selected from the group consisting of: a glass fiber, an e-glass fiber, an A-glass fiber, an E-CR-glass fiber, a C-glass fiber, a D-glass fiber, an R-glass fiber, an S-glass fiber, a cellulosic fiber, a carbon fiber, a graphite fiber, a ceramic fibers, an aramid fiber, and any combination thereof.

14. The method of claim 6, wherein the binder portion comprises a curable resin and ceramic particulate filler material.

15. A method comprising:

providing a wellbore tubular;

providing a body portion comprising a plurality of upsets disposed on an inner surface of the body portion, wherein the plurality of upsets define a first ring, a second ring, and at least one rib, wherein the at least one rib comprises one or more channels extending longitudinally through the at least one rib, and wherein the one or more channels provide fluid communication across the at least one rib, wherein the plurality of upsets comprise one or more holes;

disposing the body portion about the wellbore tubular, wherein a plurality of chambers are formed between the inner surface of the body portion, an outer surface of the wellbore tubular, and one or more surfaces of the first ring, the second ring, or the at least one rib; and introducing a binder portion material into at least one chamber of the plurality of chambers.

16. The method of claim 15, wherein disposing the body portion about the wellbore tubular comprises:

disposing a set screw in a hole disposed in the body portion; and engaging the set screw with the wellbore tubular.

17. The method of claim 15, further comprising treating the outer surface of the wellbore tubular to provide a surface for bonding to the binder portion prior to disposing the body portion about the wellbore tubular.

18. The method of claim 15, wherein the binder portion material is introduced into the at least one chamber through the one or more holes disposed in the body portion.

19. The method of claim 18, further comprising disposing a set screw in a hole of the one or more holes into which the binder portion material is introduced after the binder portion has been introduced into the at least one chamber.

20. The method of claim 15, wherein at least one hole of the one or more holes is disposed in the body portion through the at least one rib and into at least one channel of the one or more channels, and wherein introducing the binder portion material comprises introducing the binder portion material into the at least one hole into the at least one channel.

21. The method of claim 15, further comprising: passing at least a portion of the binder portion material through the one or more channels into a second chamber of the plurality of chambers.

* * * * *